United States Patent [19]

Conner

[11] Patent Number: 4,857,906

[45] Date of Patent: Aug. 15, 1989

[54] COMPLEX WAVEFORM MULTIPLEXER FOR LIQUID CRYSTAL DISPLAYS

[75] Inventor: Arlie R. Conner, Portland, Oreg.

[73] Assignee: Tektronix, Inc., Beaverton, Oreg.

[21] Appl. No.: 105,842

[22] Filed: Oct. 8, 1987

[51] Int. Cl.[4] ..... G09G 3/36

[52] U.S. Cl. ..... 340/784; 340/802; 340/805; 350/332; 350/333

[58] Field of Search ..... 340/784, 802, 805; 350/332, 333

[56] References Cited

U.S. PATENT DOCUMENTS

| | | | |
|---|---|---|---|
| 4,278,974 | 7/1981 | Kondo | 340/784 |
| 4,367,924 | 1/1983 | Clark et al. | 350/334 |
| 4,395,709 | 7/1983 | Nagae et al. | 340/784 |
| 4,508,429 | 4/1985 | Nagae et al. | 350/350 S |
| 4,548,476 | 10/1985 | Kaneko | 350/350 S |
| 4,638,310 | 1/1987 | Ayliffe | 340/805 |
| 4,645,303 | 2/1987 | Sekiya et al. | 350/332 |
| 4,681,404 | 7/1987 | Okada et al. | 340/784 |
| 4,705,345 | 11/1987 | Ayliffe et al. | 340/784 |
| 4,710,768 | 12/1987 | Takeda et al. | 340/784 |
| 4,715,688 | 12/1987 | Harada et al. | 350/333 |
| 4,725,129 | 2/1988 | Kondo et al. | 350/333 |
| 4,746,196 | 5/1988 | Umeda et al. | 350/333 |

OTHER PUBLICATIONS

Lagerwall et al., "Ferroelectric Liquid Crystals for Displays," 1985 International Display Research Conference Proceedings, IEEE, pp. 213–221 (1985).

Shimoda et al., "Optimum Bias Condition for Multiplex Driving of the Chiral Smectic C LCD", Japan Display (1986), pp. 460–462.

*Primary Examiner*—Gerald L. Brigance
*Assistant Examiner*—Richard Hjerpe
*Attorney, Agent, or Firm*—John D. Winkelman; Alexander C. Johnson, Jr.; Alan T. McCollum

[57] ABSTRACT

A matrix display drive circuit is disclosed which generates multilevel and multiphase, time-variant drive waveforms for driving the rows and columns of a ferrolectric liquid crystal matrix display. The circuit can provide up (write) and down (erase) pulses selectively to each pixel of the display using standard twisted-nematic type liquid crystal display drivers. A complex waveform generator provides multilevel, multiphase control signals to the supply voltage inputs of the drivers. Timing and synchronizing signals are extracted from the graphics data and timing source outputs to allow such multilevel, multiphase signals as may be required for the effective multiplexing of the display matrix.

26 Claims, 8 Drawing Sheets

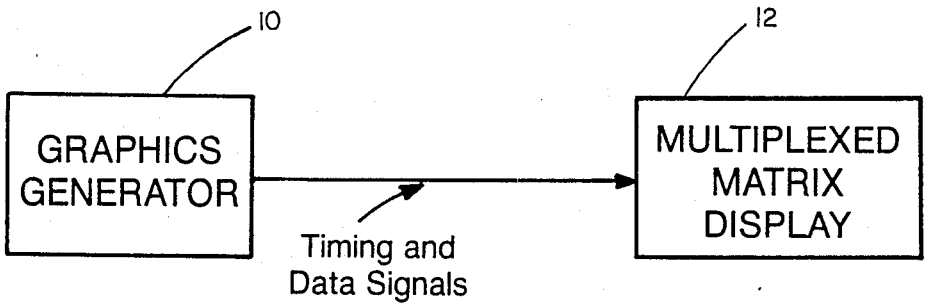
FIG 1. "PRIOR ART"
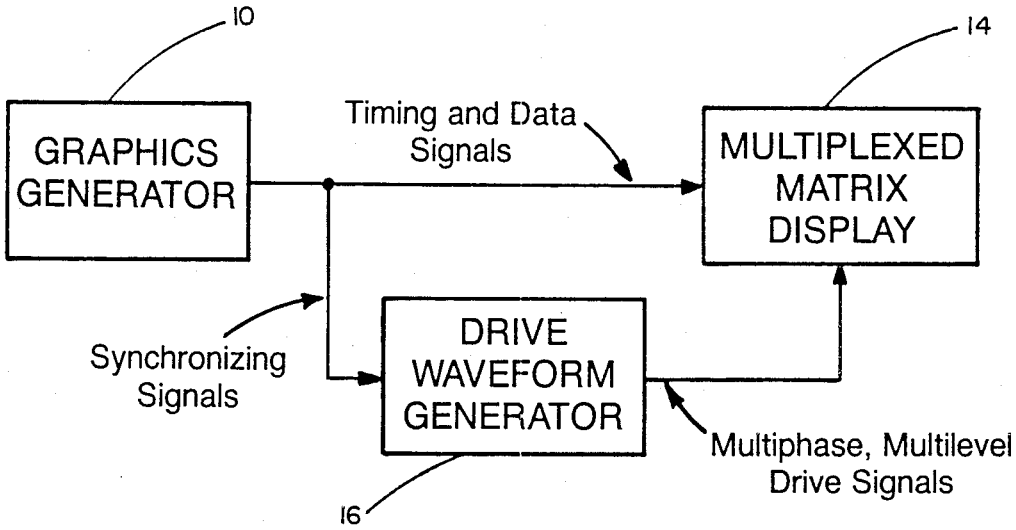
FIG 2.

COMPLEX WAVEFORM MULTIPLEXER FOR LIQUID CRYSTAL DISPLAYS

BACKGROUND OF THE INVENTION

This invention relates generally to methods and circuitry for driving matrix displays and more particularly to ferroelectric liquid crystal displays.

The idea to use ferroelectric liquid crystals in display devices was proposed by N. Clark and S. Lagerwall, U.S. Pat. No. 4,367,924. The materials used in these devices are smectic C or H liquid crystals. These are materials wherein the molecules lie in planes and the molecules are tilted within the planes and rotate in a conical locus about the planar normal. These materials exhibit bistability, that is, can be switched between two stable states by reversing the polarity of an externally applied electric field, to make a bistable electro-optical device. Chiral smectic C materials (SmC*) further possess a permanent dipole moment that lies in the smectic planes and is normal to the long molecular axis. This dipole moment couples strongly with applied electric fields and allows the rotation angle of the molecules about planar normal to be controlled by applying an electric field parallel to the smectic planes.

A ferroelectric liquid crystal cell is formed by confining a thin layer of the material between two layers of glass. The ferroelectric liquid crystal molecules at the surface of the glass are constrained to be flat against the surface. The director field can thus adopt two uniform states. Electrodes are applied to the sheets of glass to complete the liquid crystal cell. The field applied by the electrodes will be parallel to the smectic planes if the planes are oriented normal to the surfaces of the glass. Clark et al. describe a method for attaining this orientation. The resultant structure provides a liquid crystal display device comprising a matrix of pixels that are switchable between at least two display states. By use of polarizers, the states can be made optically distinguishable.

The ability to make operable ferroelectric liquid crystal matrix display devices work has been demonstrated. A number of problems arise, however, in trying to design a practical, commercially-applicable ferroelectric liquid crystal display. Among the most important considerations is how to drive the display.

Most liquid crystals that have been employed in conventional practice for display devices are twisted nematic-type liquid crystals. Nematic liquid crystals have a positive dielectric anisotropy. When no electric field is present, such crystals form a twisted structure in the direction of the thickness of the liquid crystal layer. A group of scanning electrodes and a group of signal electrodes are conventionally arranged so as to intersect with each other and form a matrix. A time sharing driving method is employed for driving these displays. Address signals are sequentially applied to a group of common electrodes serving as scanning electrodes. Information signals are selectively applied to the signal electrodes in parallel synchrony with the address signals. Twisted nematic liquid crystals can be effectively driven by applying static DC signals to the electrodes. These signal levels are conventionally provided by a fixed resistive-capacitive voltage divider. A typical driver circuit for twisted nematic-type liquid crystal displays is the MSM5260 GSK Model 80 bit LCD dot matrix driver and associated circuitry, manufactured by OKI Electric Industry Co., Ltd., of Sunnyvale, Calif.

For a number of reasons, conventional driver circuitry of the type used for twisted nematic liquid crystal displays is not satisfactory for ferroelectric liquid crystal displays. Such a driver typically includes a serial-to-parallel N-bit shift register into which display data (for the column or X driver) and line select data (for the row or Y driver) are input. The shift register outputs the data in parallel to a latch, which passes the data to an N-wide 4:1 analog multiplexer array. Each multiplexer has two select inputs, one of which (FR) is common to all, the other (DATA) connected to receive data from the latch. The multiplexers each have four voltage level inputs in common. The static DC levels are applied to these inputs. These circuits are powered from a supply voltage $V_{DD}$ (typically +5 VDC) and $V_{SSH}$ (variable according to temperature, LCD type, and matrix size). In the MSM 5260, $V_{DD}$ also serves as one of the static DC reference voltage inputs (V1). The FR input is conventionally inverted in a 50% duty cycle, typically once per frame but, in some implementations, as often as once per line, to select between pairs of the static voltage inputs.

In ferroelectric displays, it is necessary to have bistable latching, that further has some threshold. In an actual matrix device there will always be some background voltages present at every pixel. It is important that these voltages not lower the contrast or change the state of a pixel but, on the other hand, that only a slightly greater voltage suffices to change the state of the pixel.

Another concern has to do with the nature of the electrical waveforms to be applied to the ferroelectric display device. In a ferroelectric device, a "+" polarity pulse switches a pixel to one state and a "−" pulse to the other. There is a threshold associated with this process that is, roughly speaking, related to the area under the pulse. Sub-threshold pulses (those that do not cause switching), however, can disturb the pixel. That is, while the pulse is applied, the director configuration distorts. In a matrix device, strobe waveforms will be applied to transparent conductive rows on one cell surface, and data waveforms to columns on the other surface. Waveforms applied to the rows and columns of the device produce a difference waveform from a particular row and column at each pixel. This difference waveform needs to be +V or −V during each time frame to set the selected pixels in a desired state. The rest of the time, the difference waveform should do nothing to the pixels. The data signals should affect the strobed row, setting the pixels in that row ON or OFF, while leaving the pixels in non-strobed rows unchanged. The rows are strobed sequentially so that a pixel sees the resultant of a strobe waveform and the data waveform for 1/N of the time (N=total number of matrix lines) and sees the data voltage alone for the rest of the time. It turns out that a continuously-applied DC voltage, even if it is quite small, will affect the pixels' state. Thus, another requirement for ferroelectric liquid crystal display devices is that the background voltage be "AC-like."

Lagerwall et al., in the Proceedings of the 1985 International Display Research Conference, IEEE, pages 213–221 (1985), have proposed a five-phase drive waveform to meet these needs (see FIG. 5). It requires that each row be addressed five times in a frame cycle: once to switch pixels in a row "up"; once to cancel the DC component of the first switching pulse; once to switch pixels in the row "down"; once to cancel the DC component of the third switching pulse; and once more to further increase the AC nature of the resultant waveform. Looking at the resultant waveforms, it can be seen that an "up" signal really goes "down-up" and a "down" signal really goes "up-down." Also, the data voltage waveform has "+" pulses followed by "−" pulses and vice versa to minimize the effect of the "background" voltage each pixel sees by making it more "AC" like. Lagerwall et al. have not, however, disclosed any practical, commercially-applicable driver for implementing the proposed multiplexing scheme in a ferroelectric liquid crystal matrix display.

There are also two objectionable features to the Lagerwall et al. waveform. One problem is that the black area of the screen may tend to flicker if the refresh rate is slow. This is because black pixels will momentarily flash white during each refresh cycle. The other problem is that the refresh cycle will tend to take a lot of time because each row must be addressed with a five-phase sequence, where each phase interval is roughly equal to the switching speed of a pixel. Thus, if a pixel can be switched in 100 microsecs, 500 microsecs per line is required for every frame update of matrix device.

Other driving methods have been proposed for ferroelectric liquid crystal displays but these do not adequately address the concerns outlined above. U.S. Pat. No. 4,548,476 to Kaneko proposes a time-sharing driving method that is designed to reduce the number of drivers required in a print-bar ($1\times N$) array by making the array geometrically appear as, for example, a $3\times N/3$ matrix. An electrode matrix is formed by two groups of electrodes, oppositely spaced from one another and arranged so as to intersect one another to form matrix intersection points. One group serves as the row electrodes; the other as the signal electrodes. Voltage is applied to each row electrode in a time-sharing manner such that the voltage applied to a selected intersection point is in a direction opposite the voltage applied to adjacent intersection points. Kaneko discloses a two-level, two-phase drive scheme. This patent does not address the nature of the drivers themselves, or the problems of complex multiplexing, as set out above, in a large (i.e., $M\times N$ where both M and N are typically greater than $2^6$) matrix display.

U.S. Pat. No. 4,508,429 to Nagae et al addresses the drive issue directly and describes a method for controlling a switch for producing a two-level waveform ($+V_p$ and $-V_p$) and DC-offset variations thereof to switch and periodically refresh the state of the liquid crystal, in a scheme that provides an average voltage level of zero. It does not adequately deal with the above-described concerns, however, because it does not involve bistable liquid crystals. Also, the form of drive circuit disclosed would, apparently have to be duplicated for each row and column of the matrix. This is not a practical solution for a large matrix display. The circuit also does not provide for a multitude of levels and durations.

Accordingly, a need remains for a suitable driver for complex waveform multiplexing of a bistable ferroelectric liquid crystal matrix display.

SUMMARY OF THE INVENTION

The present invention enables ordinary twisted-nematic LCD drivers to be used for driving chiral smectic C (SmC*) and other ferroelectric matrix display devices. Usually, in a twisted nematic liquid crystal display (LCD) driver, a data bit selects one of two voltage levels supplied to the driver circuit. In accordance with the invention, these fixed voltages are replaced with multi-phase waveforms. Then, the data bit can select one of two waveforms rather than voltage levels.

A liquid crystal display according to the invention comprises a matrix display panel having a two-dimensional array of liquid crystal display elements switchable between at least two display states. A row and a column driver circuit means is provided for driving a row and column, respectively, of the array. Multiple-output driver means are used for matrix displays. These can be provided by conventional twisted-nematic LCD integrated circuit drivers. Each such driver includes at least two drive level inputs (four in most conventional drivers), at least two logical selection inputs, and a plurality of outputs connected to control lines of the display elements for switching the display elements between display states.

A display controller means is connected to the logical selection inputs for controllably connecting the display to a graphical data source to control selection of display states of the display elements. A waveform generator means, having at least two outputs, is connected via each output to one of the drive level inputs for applying a predetermined time variant signal to the driver circuit means.

The waveform generator means preferably includes timing and switching means for generating at least two predetermined waveforms defining the time variant signal and providing each of said waveforms as an output signal through output buffer means to the two drive level inputs. The timing and switching means is preferably operative to switch at least one of the waveforms among at least three predetermined levels. The output buffer means are arranged to provide a gain and output level within a predetermined dynamic range, within the safe operating limits of the driver circuit means and sufficient to enable the driver circuit means to actuate the display elements for switching between said two states. These drive level conditions are satisfied, for the row drivers, when $V_{SSH}\leqq V4\leqq V1\leqq V_{DD}$ and, for the column drivers, when $V_{SSH}\leqq V3\leqq V2\leqq V_{DD}$, where $V_{SSH}$, V1, V2, V3 and V4 are variable waveforms obtained by switching among predetermined static reference voltage inputs to the driver circuit. The output buffer means each have a low impedance output.

The controller means preferably includes timing means for generating a timing signal output to the driver circuit means for synchronizing the logical selection of the display elements. The timing and switching means correspondingly includes at least one input connected to receive the timing signals from the controller means and phase timing means responsive to the timing signals for synchronizing the waveform to a predetermined phase with the logical selection of the display elements. The timing and switching means can be provided by a 4:1 analog multiplexer having select means responsive to the timing signals for selecting among sets of four input reference voltages.

The foregoing and other objects, features and advantages of the invention will become more readily apparent from the following detailed description of a preferred embodiment which proceeds with reference to the accompanying drawings.

BRIEF DESCRIPTION OF THE DRAWINGS

FIG. 1 is a block diagram of a conventional computer-driven liquid crystal matrix display.

FIG. 2 is a block diagram of a computer-driven liquid crystal matrix display in accordance with the invention.

DETAILED DESCRIPTION

FIG. 1, shows a conventional arrangement of processor based graphics generator 10 connected to transmit timing and data signals to a multiplexed matrix display 12 for display of data. The matrix display is provided by a twisted nematic-type liquid crystal display driven by conventional LCD dot-matrix drivers.

Referring to FIG. 2, the above-described arrangement of a graphics generator and multiplexed matrix display is utilized in the present invention. In accordance with the invention, however, the multiplexed matrix display can be provided by ferroelectric matrix display 14, driven by conventional drivers, in combination with a drive waveform generator 16. In general, synchronizing signals are extracted from the timing and data signals provided by the graphics generator to the matrix display, and synchronizing signals are input to the waveform generator. And, in accordance with the invention, the waveform generator provides multiphase, multilevel drive signals, synchronized with the timing and data signals, to the matrix display drivers. This arrangement is further detailed in the functional block diagram of FIG. 3.

Figure 3:
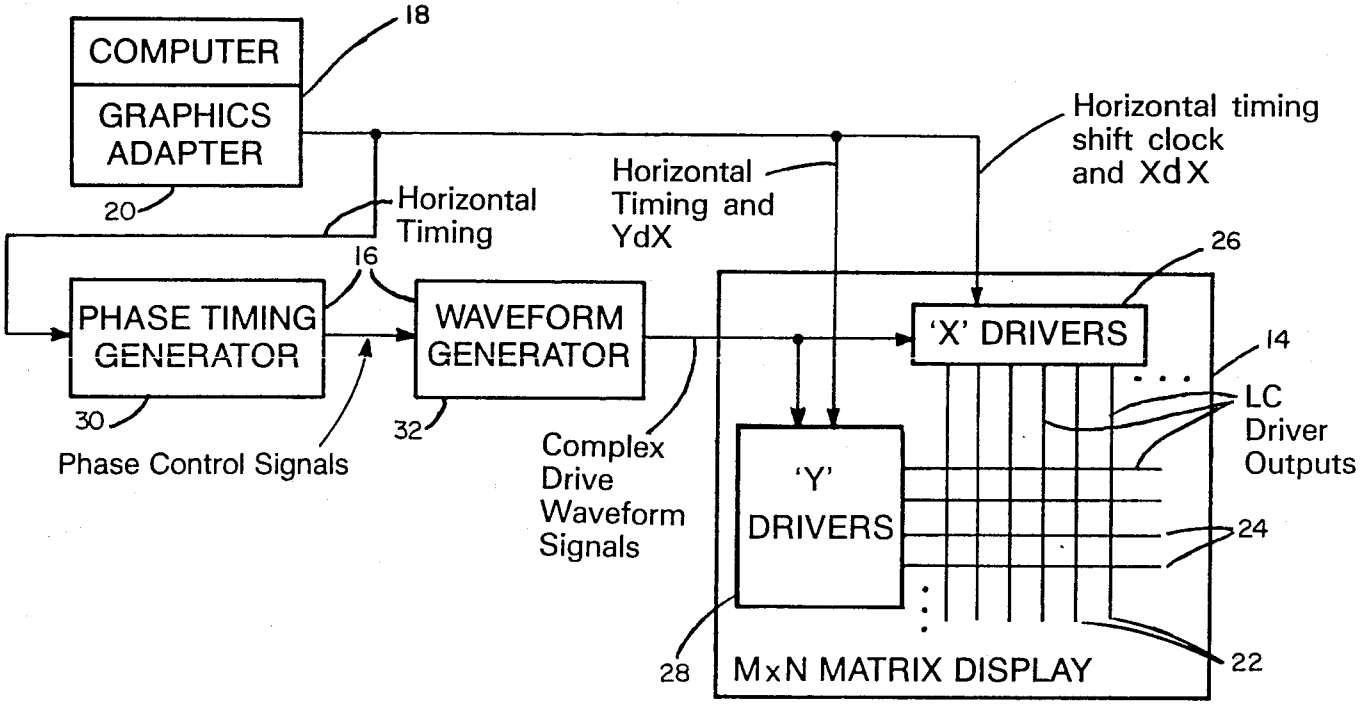
FIG. 3 is a more-detailed functional block diagram of a ferroelectric liquid crystal matrix display in accordance with the invention.

In FIG. 3, the graphics generator is provided by a computer 18 with a graphics adapter 20. Other forms of graphics generator can readily be used, such as a television receiver or video cassette recorder. In one operational implementation, the computer is provided by an IBM AT personal computer, having an IBM graphics adapter and then Epson video-to LCD interface adapter. The interface adapter conventionally has 5 timing and data signal outputs: horizontal timing (YSCL), shift clock (XSCL), Y data (Ydx), raster X data (Xdx) and frame alternate (FR). The raster X data (Xdx) may be parallelized, e.g., four bits at once, to reduce shift clock speed.

Display 14 is a ferroelectric matrix display comprising M rows and N columns; where M and N are typically greater than $2^6$, the structure of the matrix display can take any of a number of forms known in the art. Typically, such a display takes the form of a sandwich structure composed of a pair of transparent, rigid planar members closely spaced about a layer of ferroelectric material of predetermined thickness. A set of X or column electrodes are arrayed one side of the display and a set of Y or row electrodes are arrayed on the opposite side of the display so as to intersect with each other to form matrix intersecting points. These electrodes are connected in turn to X drivers 26 and Y drivers 28, respectively. These drivers can be provided by any number of conventional drivers used in twisted nematic type matrix displays. In an example of the invention, further described hereinafter with reference to FIG. 4 and FIG. 7, the X drivers are provided by an Epson SED 1180 column driver and the Y drivers by an Epson SED 1190 row driver.

The X drivers 26 have, as inputs, the horizontal timing, shift clock and Xdx signals from graphics 20. The Y drivers 28 receive, as inputs from the graphics adapter, horizontal timing and Ydx signals. Additional inputs to the X and Y drivers 26, 28 are provided in accordance with the invention, as next described.

The drive waveform generator 16 includes two functional elements. A phase timing generator 30 receives horizontal timing signals from graphics adapter 20 and outputs phase control signals. These phase control signals are input to waveform generator 32, which provide logic and complex drive waveform signals to the X and Y drivers 26, 28. The phase timing generator 30 is shown in further detail in FIG. 8 and the waveform generator 32 is detailed in FIG. 4.

Figure 8:
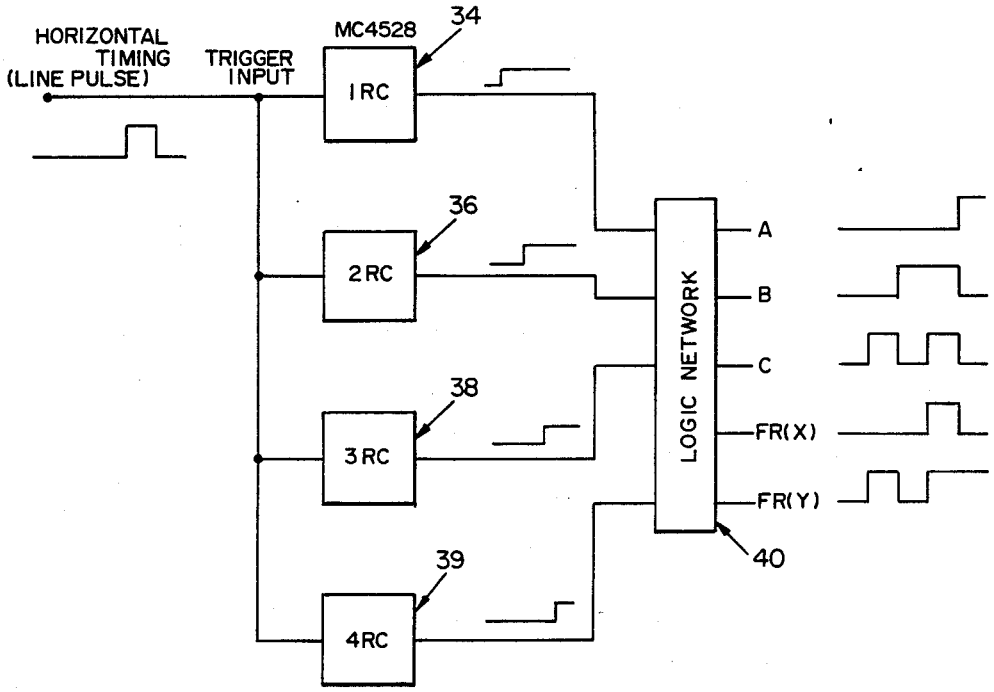
FIG. 8 is a block diagram of the timing generator and decoder.

Referring first to FIG. 8, the timing generator receives horizontal timing signals in the form of a synchronization pulse that occurs once during each raster line of X data (Xdx). The timing generator produces a number of phase control signals. These signals serve two functions. First, they serve to establish a predetermined phase relationship with the horizontal timing signal and thereby synchronize the complex drive waveform signals output from the waveform generator with the X and Y data input to the drivers. Second, they provide switching control signals which occur several times during each raster line of X data.

The timing generator can take a number of forms. In one example, it is implemented by four fixed-time, one-shot circuits 34, 36, 38 and 39 to provide five-phase waveform signals, as further described hereinafter. For a three-phase waveform two one-shots are sufficient and the decoding is simpler. The same function could be performed digitally using the shift clock signal as input in addition to the horizontal timing, to generate the phase control signals; thus changing the phase control signals with the frame rate.

Figure 4:
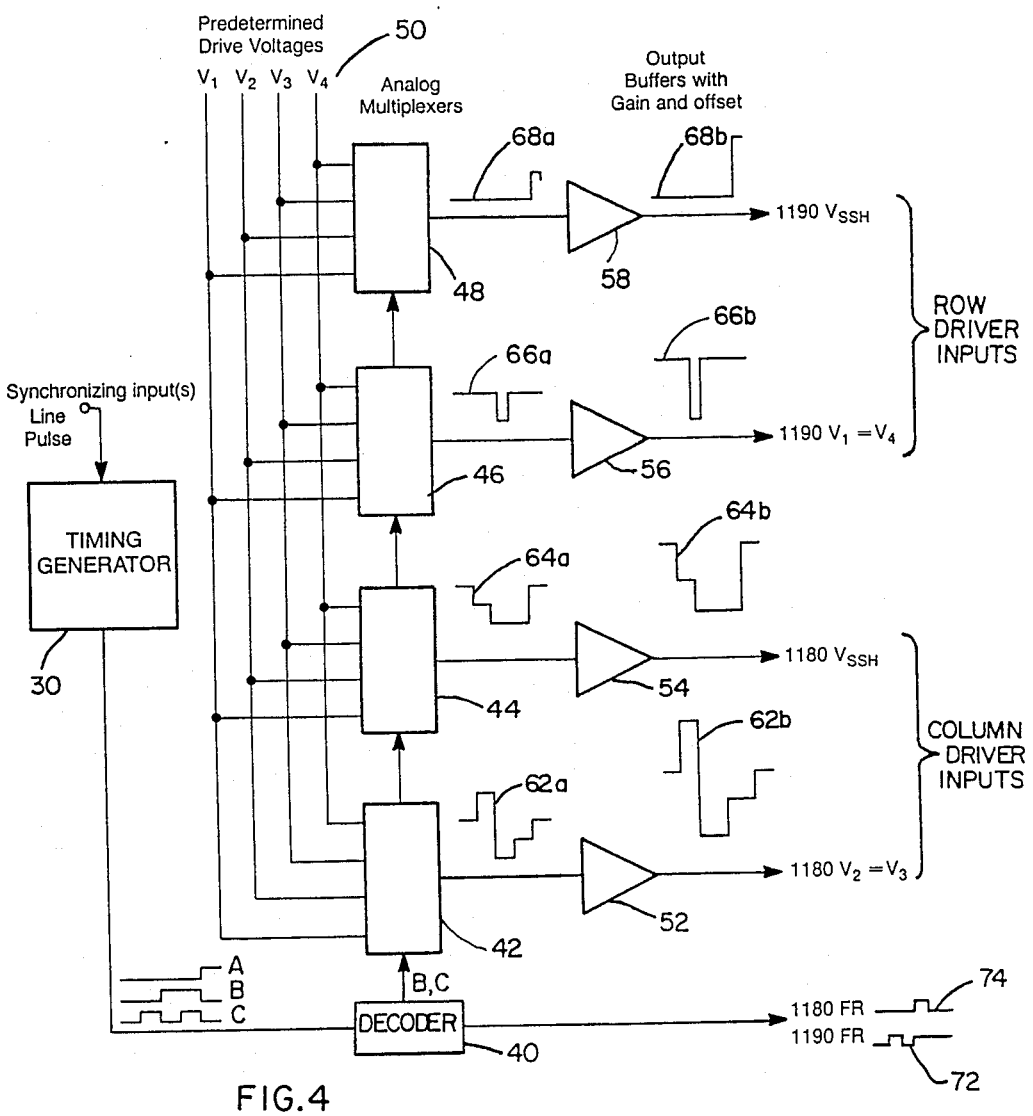
FIG. 4 is a block diagram of the waveform generator circuit for implementing the display of FIG. 3, using an inverted Lagerwall 5-phase ferroelectric drive scheme.

Referring to FIG. 4, the phase control signals are input to a decoder 40. The decoder, in turn, provides outputs that are connected to SELECT inputs of four analog multiplexers 42, 44, 46, 48. Each of these multiplexers is a 4:1 multiplexer having four inputs connected to predetermined drive voltages V1, V2, V3 and V4, and a single output. The output of each multiplexer is connected to a buffer amplifier, 52, 54, 56, 58, respectively. The outputs of these buffers are then provided as row and column driver inputs to the Y and X drivers 28, 26 of display 14.

Figure 6:
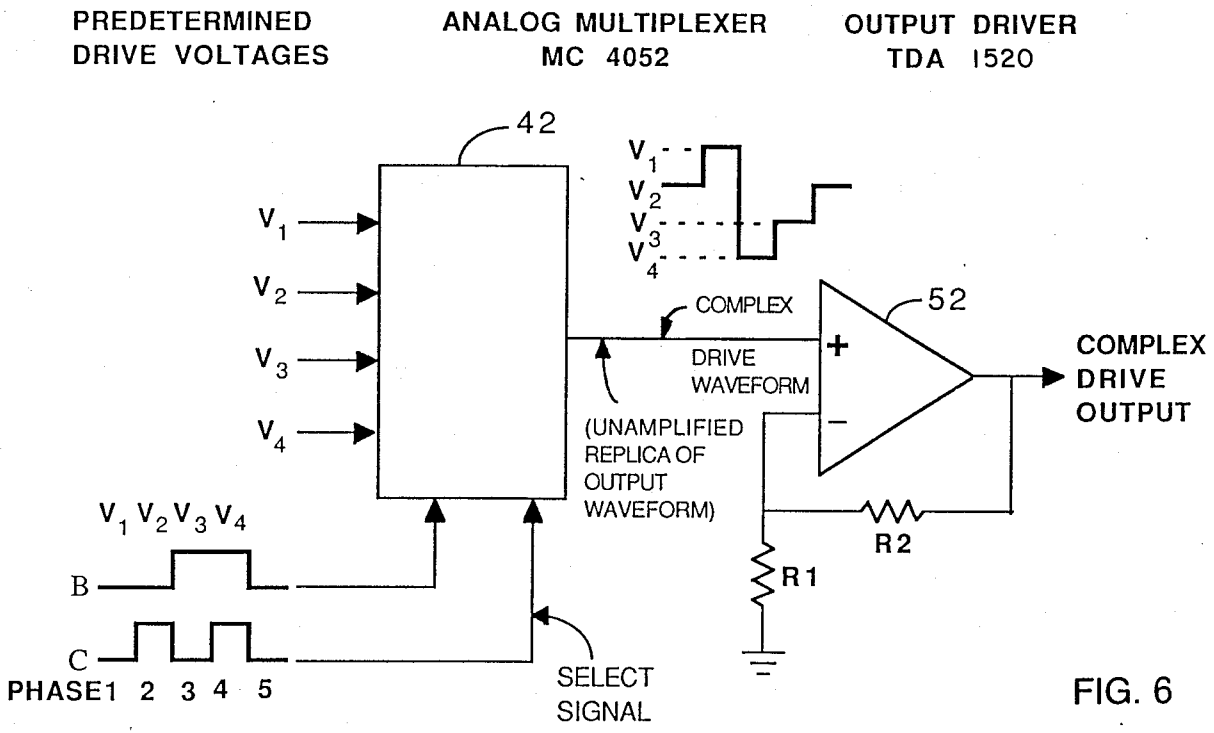
FIG. 6 is a schematic of a preferred implementation of the waveform generator circuits of FIG. 4.

Referring to FIG. 6, an operational example of the waveform generator 32, is implemented with a Motorola model MC 4052 analog multiplexer and a Signetics model TDA 1520 output driver. The multiplexer has two SELECT inputs, each of which are connected to receive two of the three phase control signals input to decoder 40. A combination of phase control signals input to each multiplexer is logically chosen to produce a predetermined output waveform from each multiplexer, shown as waveforms 62*a*, 64*a*, 66*a*, and 68*a*. When these waveforms are input to the output buffers, they are output to the X and Y drivers in a form that replicates the input waveform shape and timing but with a different gain and offset, as needed for the particular form of drivers. The drivers used in the above-mentioned example have a 27 volt range, which condition is readily met in the example by output waveforms which vary over a 15 volt range in 5 volt steps from −10 volts to +5 volts (see FIG. 7).

Besides the above-described row and column driver inputs, the waveform generator FIG. 4 provides two "FR" signals to the row and column. Conventional twisted nematic type drivers and have a frame alternate (FR) input which, in conventional usage is connected to the corresponding "FR" output of graphics adapter 20. That output, which is not used in the present invention, is a logic signal with a 50% duty cycle. Typically, this logic signal is switched once each frame and in some conventional implementations is switched as often as once per raster line of X data. In accordance with the invention, this input to the X and Y drivers is switched as least two times within each raster line of data. Accordingly for the X drivers, during each raster of X data (Xdx) the FR signal 72 is normally low for a portion of the raster line time interval, switches to a high state for a portion of that interval and then returns to a low state for a remainder of the raster time interval. The FR signal 74 input to the Y driver starts the raster time interval in a low state, switches high, then low, and then remains high for the remainder of the time interval.

TABLE 1

| MC4052 pin number | Analog Multiplexer (Reference Numbers from FIG. 4): 48 | 46 | 44 | 42 |
|---|---|---|---|---|
| 1 (Y0) | V1 | V1 | V2 | V1 |
| 5 (Y1) | V1 | V1 | V1 | V2 |
| 2 (Y2) | V1 | V3 | V4 | V3 |
| 4 (Y3) | V3 | V1 | V4 | V4 |
| 10 (Select A) | A | C | C | C |
| 9 (Select B) | A | B | B | B |
| 3 (Y) | 1190 | 1190 | 1180 | 1180 |
| | $V_{SSH}$ | $V_{\frac{1}{4}}$ | $V_{SSH}$ | $V_{\frac{3}{4}}$ |

Table 1 shows the actual connections used in the MC4052 to produce the waveforms of FIG. 4.

Figure 5:
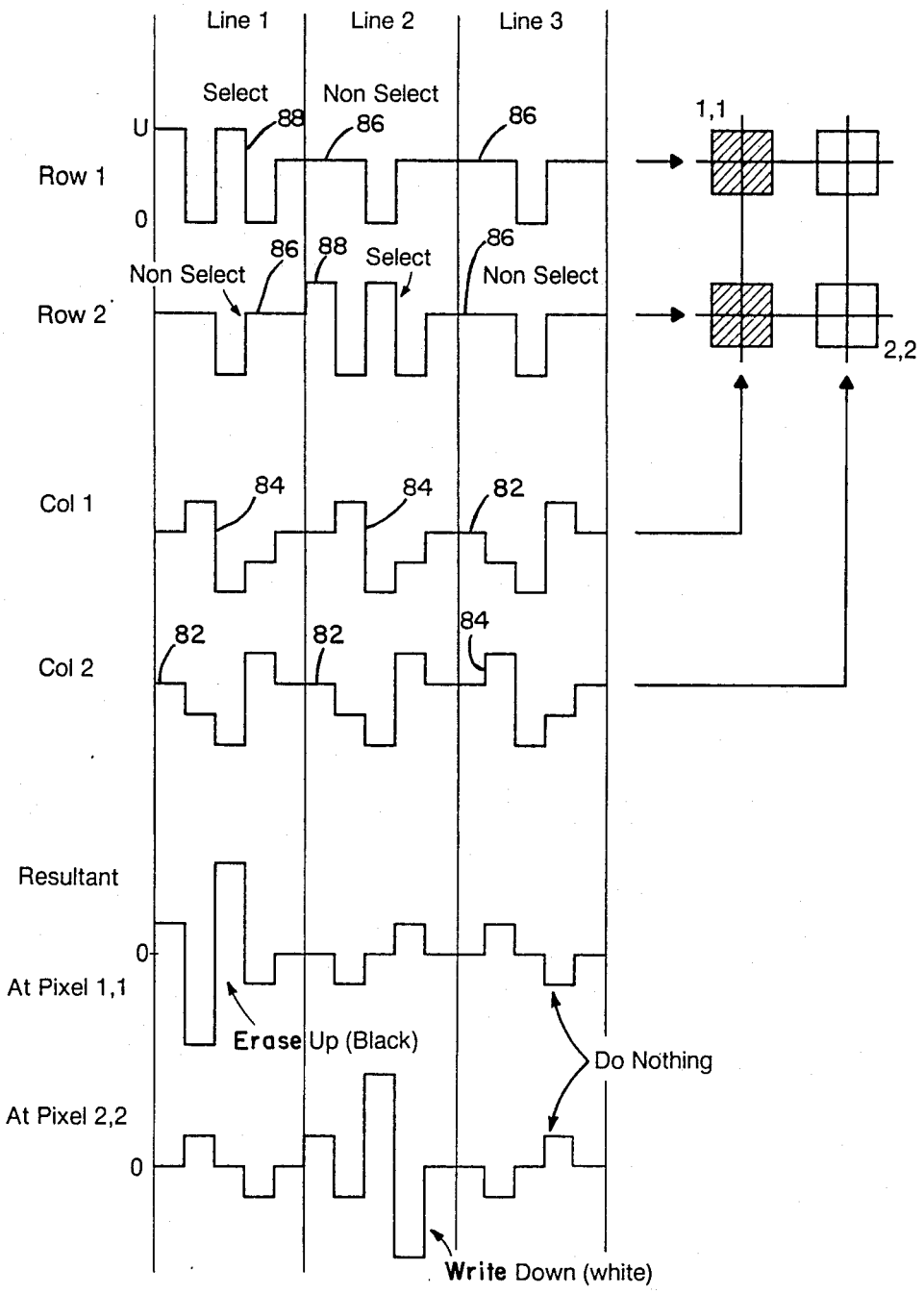
FIG. 5 is an output waveform diagram for the five-phase drive scheme of FIGS. 3 and 4.

FIG. 5 show an inverted form of the Lagerwall 5-phase ferroelectric liquid crystal display drive screen scheme. The first two illustrated waveforms show the signals applied to rows 1 and 2 of the matrix display by the Y drivers 28. The second two waveforms show the signals applied to columns 1 and 2 of the display by the first and second LC driver outputs from the X drivers 26. The last two waveforms in FIG. 5 illustrate the resultant signal applied to pixel 1,1 and pixel 2,2 to select their respective, different display states. The manner in which these waveforms combine at each intersection of the matrix driver output lines to produce the resultant waveforms that switch certain pixels to a black display state, other pixels to a white display state and do nothing to the prior display state of the remaining pixels is described in the above-mentioned articles by Lagerwall et al, and therefore, need not be further described herein.

Figure 7:
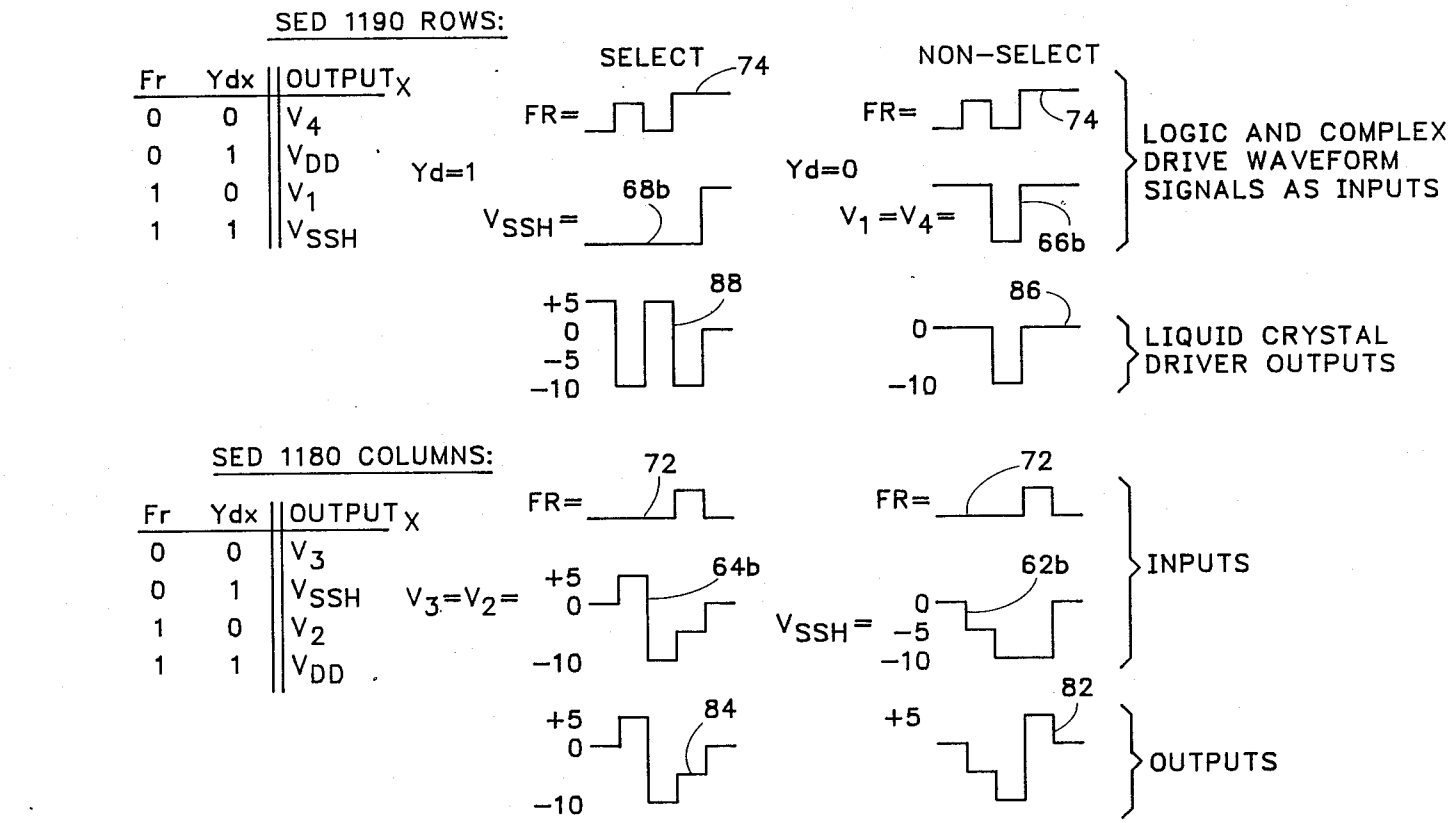
FIG. 7 is a set of input/output diagrams for the driver implementation of FIG. 4 to produce the output signals of FIG. 5.

FIG. 7 illustrates how the row and column driver waveforms of FIG. 5 are developed in accordance with the invention. The FR signal 74 is applied to the row driver for both the selected and non-selected rows. Waveform 68*b* is applied to the selected rows and waveform 66*b* to the non-selected rows. Similarly, FR signal 72 is applied to the column driver FR input for both the selected and non-selected displays. Waveforms 64*b* and 62*b* are alternately applied to the inputs of the column as required to select or non-select each respective column. The resultant driver outputs are illustrated for each of the input waveforms. Output waveform 82 corresponds to input waveform 62*b* and output 84 corresponds to input 64*b*, for the columns. Similarly, the non-select output 86 corresponds to input 66*b*, and the select output 88 corresponds to input 68*b* for the row drivers. The left portion of FIG. 7 shows the logic tables that determine the form of output signals 82, 84, 86 and 88. The resultant waveforms applied to each pixel are the algebraic difference between the row and column waveforms at each intersection of the row and column electrodes.

Figure 9:
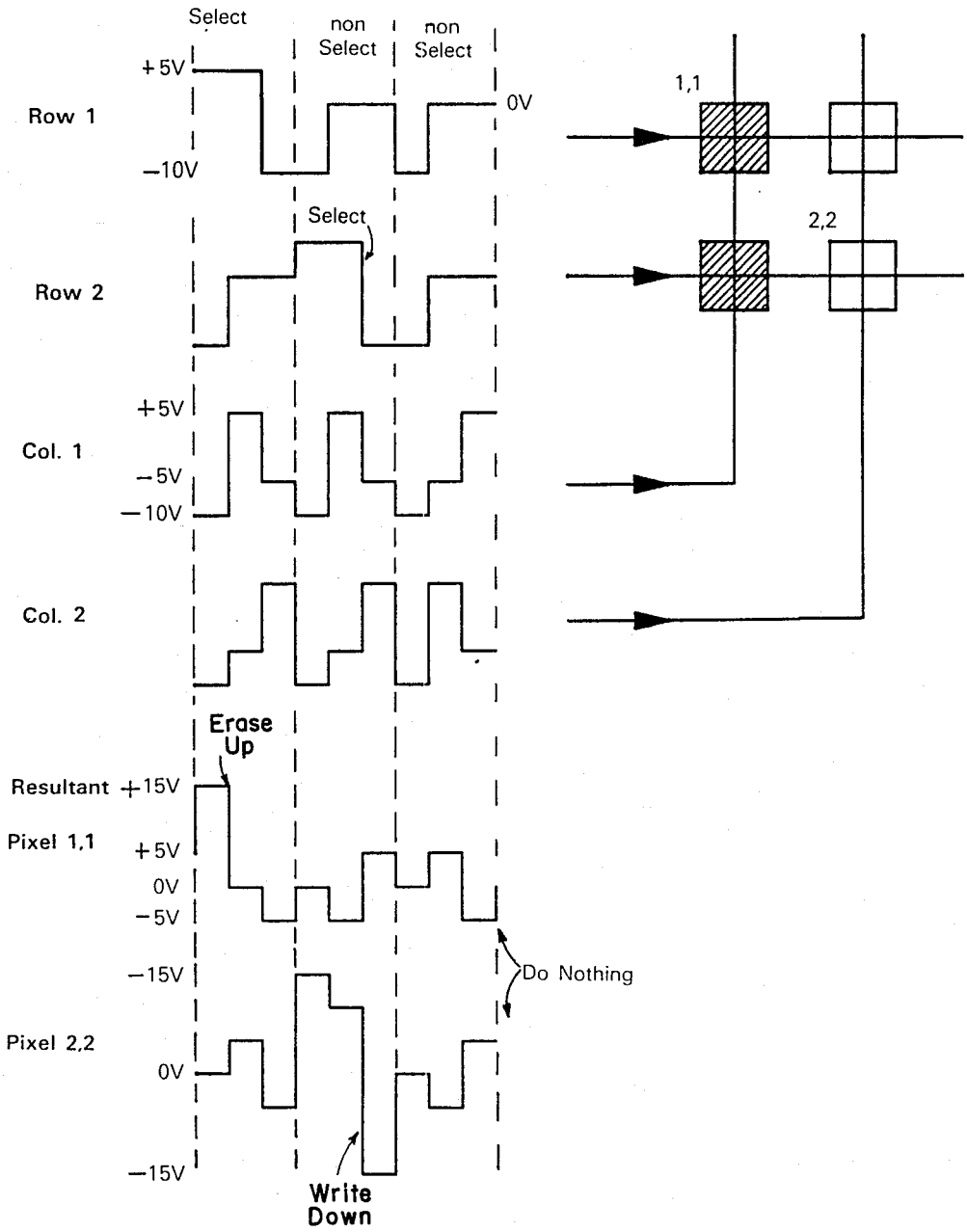
FIG. 9 is an output waveform diagram for a three-phase drive scheme in accordance with an alternative embodiment of the invention.

The invention can readily be applied to waveforms other than the Lagerwall five-phase drive scheme. For example, a three phase drive scheme can be implemented in FIG. 9. The three phase drive scheme produces less tendency to flicker in the black area of the display if the refresh rate is slow and reduces the time required for a refresh cycle to 3/5 of the time required by the Lagerwall drive scheme. For a three-phase waveform, the timing generator can be provided by two one-shot circuits and the decoding logic can be correspondingly simpler. The three-phase waveform has a non-zero DC offset but it is ordinarily negligible in matrix displays. In this scheme there will be an average DC offset equal to twice the data voltage divided by 3 times the number of rows in the matrix device. This will typically amount to around 5 millivolts which can be ignored in many applications.

Having illustrated and described the principles of my invention in a preferred embodiment thereof, it should be readily apparent to those skilled in the art that the invention can be modified in arrangement and detail without departing from such principles. I claim all modifications coming within the spirit and scope of the accompanying claims.

I claim:

1. A liquid crystal display comprising:

a matrix display panel having a two-dimensional array of liquid crystal display elements switchable between at least two display states;

at least one of a row and a column driver circuit means, each driver circuit means having at least two drive level inputs, a logical selection input, and a plurality of outputs connected to control lines of the display elements for switching the display elements between said display states;

display controller means connected to the logical selection input for connecting the display to a graphical data source for controlling selection of display states of the display elements, said controller means having a timing signal output controllably coupled to the driver circuit means:

waveform generator means having at least two outputs, each output being connected to one of the drive level inputs for applying a time variant signal to the driver circuit means, said waveform generator means further having timing and switching means and generating at least two predetermined waveforms for each driver circuit which vary among at least three levels within a predetermined dynamic range and through at least three phases in a predetermined sequence for each occurrence of the logical selection of the display state of the display elements, and providing each of said waveforms as said time variant signals to the drive level inputs, said timing and switching means including at least one phase timing signal input;

phase timing means having an output coupled to the phase timing signal input and responsive to the controller means timing signal to provide phase timing signals to the timing and switching means for synchronizing the waveforms to a predetermined phase with the logical selection of the display elements.

2. A display according to claim 1 in which the waveform generator means includes at least two output buffer means, each having one of the waveform output signals as an input, for inputting each of said waveforms to a different drive level input.

3. A display according to claim 2 in which the output buffer means are arranged to provide a gain and output level within a predetermined dynamic range sufficient to enable the column driver circuit means to actuate the display elements for switching between said two states.

4. A display according to claim 2 in which the output buffer means are arranged to provide a gain and offset drive level for the time variant drive signals such that the conditions $V_{SSH} \leqq V4 \leqq V1 \leqq V_{DD}$ for the row drivers and $V_{SSH} \leqq V3 \leqq V2 \leqq V_{DD}$ for the column drivers are always satisfied, where $V_{SSH}$, V4, V3, V2 and V1 are variables defining said predetermined waveforms and $V_{DD}$ is a reference voltage.

5. A display according to claim 2 in which the output buffer means each have a low impedance output.

6. A display according to claim 2 in which the timing and switching means is operative to switch at least one of the waveform output signals among three and only three predetermined levels and through three and only three phases.

7. A display according to claim 1 in which the matrix display panel is a ferroelectric liquid crystal display and the waveform generator means includes switching means for switching among three and only three predetermined levels and through three and only three phases to generate a waveform output signal defining said time variant signal.

8. A display according to claim 7 in which the controller means includes timing means for generating a timing signal output to the driver circuit means for controllng the logical selection of the display states of the display elements and the waveform generator means includes phase timing means responsive to the timing signal output for synchronizing the waveform output signal to a predetermined phase with the logical selection of the display elements.

9. A display according to claim 1 wherein said controller means includes means for generating a first logical selection signal comprising a data signal which is provided to a first logical selection input;

said driver circuit means includes a second logical selection input; and said phase timing means further includes means responsive to the controller means timing signal for producing a second logical selection signal on an output thereof which is connected to said second logical selection input, said second logical selection signal having a predetermined phase relationship with the waveforms applied to the drive level inputs for switching the driver circuit means outputs.

10. A display according to claim 9 wherein:

the controller means timing signal comprises horizontal synchronization pulses;

said phase timing means includes means for creating an integer number of phase transitions defining at least three phases for each horizontal synch pulse period, said waveform generator means being responsive to produce said predetermined waveforms with phase changes in synchrony with said phase transitions; and said means for producing a second logical selection signal includes means for switching said second signal at least once in synchrony with one of the phase transitions during each horizontal synchronization pulse period.

11. A display according to claim 1 wherein the controller means timing signal comprises a horizontal synchronization pulse.

12. A circuit for complex waveform multiplexing of a matrix display panel having a two-dimensional array of liquid crystal display elements switchable between at least two display states, the circuit comprising:

row and column driver circuit means, each driver circuit means having at least two drive level inputs, a logical selection input, and a plurality of outputs connected to control lines of the display elements for switching the display elements between said states;

display controller means controllably connected to the logical selection input for connecting the display to a graphical data source to control selection of display states of the display elements; and waveform generator means having at least two outputs, each output being connected to one of the drive level inputs for applying a time variant output signal to the driver circuit means;

the waveform generator means including a timing and switching means for generating, as each time variant output signal, a predetermined waveform which varies among three and only three levels with a predetermined dynamic range and through three and only three phases in a predetermined sequence for each occurrence of the logical selection of the display state of the display elements, said timing and switching means having an input connected to receive a timing signal from the controller means and phase timing means responsive to the timing signal for synchronizing the three-level, three-phase waveforms to a predetermined phase with the logical selection of the display elements.

13. A circuit according to claim 12 in which the controller means includes means for generating a timing signal output to the driver circuit means for synchronizing the logical selection of the display elements.

14. A method of complex waveform multiplexing of a matrix display panel having a two-dimensional array of ferroelectric liquid crystal display elements and a plurality of intersecting control lines for switching selected display elements between two display states in accordance with logical selection input signals from a graphical data source, the method comprising:

providing row and column driver circuits, each driver circuit having a plurality of drive level inputs, logical selection input means for inputting binary data from the graphical data source, logical control means for selecting among the drive level inputs in accordance with such binary data, and a plurality of outputs connected to the control lines of the display elements for switching the display elements between said states in accordance with the binary data;

switching among a set of predetermined drive voltage levels to generate a plurality of predetermined waveforms for each driver circuit which vary among at least levels within a predetermined dynamic range and through at least three phases in a predetermined sequence for each occurrence of the logical selection of the display state of the display elements; and controlling the phasing and magnitude of such predetermined waveforms such that the conditions $V_{SSH}<V4<V1<V_{DD}$ for the row drivers and $V_{SSH}<V3<V2<V_{DD}$ for the column drivers are satisfied, where $V_{SSH}$, V4, V3, V2 and V1 are variables defining said predetermined waveforms and $V_{DD}$ is a reference voltage.

15. A method according to claim 14 including:

generating a timing signal from the graphical data source;

applying the timing signal to the logical control means for timing the selection among the drive level inputs; and synchronizing the waveforms to a predetermined phase with the logical selection of the display elements in accordance with the timing signal.

16. A method according to claim 14 wherein the switching step is controlled so that the predetermined waveforms for each driver circuit vary among three and only three levels within a predetermined dynamic range and through three and only three phases in a predetermined sequence for each occurrence of the logical selection of the display state of the display elements.

17. A liquid crystal display comprising:

a matrix display panel having a two-dimensional array of liquid crystal display elements switchable between at least two display states;

at least one of a row and a column driver circuit means, each driver circuit means having at least two drive level inputs, at least two logical selection inputs, and a plurality of outputs connected to control lines of the display elements for switching the display elements between said display states;

display controller means connected to the logical selection inputs for connecting the display to a graphical data source for controlling selection of display states of the display elements, and including timing means for generating a timing signal output to the driver circuit means for synchronizing the logical selection of the display elements; and; and waveform generator means having at least two outputs, each output being connected to one of the drive level inputs for applying a time variant signal to the driver circuit means, said waveform generator means further having:

timing and switching means for generating at least two predetermined waveforms for each driver circuit which vary among at least three levels within a predetermined dynamic range and through at least three phases in a predetermined sequence for each occurrence of the logical selection of the display state of the display elements, and providing each of said predetermined waveforms as an output signal, said timing and switching means includes at least one input connected to receive the timing signal from the controller means and phase timing means responsive to the timing signal for synchronizing the waveform to a predetermined phase with the logical selection of the display elements; and;

at least two output buffer means, each having one of said waveform output signals as an input, for inputting each of said waveforms to a different drive level input, said output buffer means being arranged to provide a gain and offset drive level for the time variant drive signals such that one time variant signal is always less than or equal to another.

18. A display according to claim 17 wherein said output buffer means is arranged to provide a gain and offset drive level for the time variant drive signal such that the conditions $V_{SSH}\leqq V4\leqq V1\leqq V_{DD}$ for the row drivers and $V_{SSH}\leqq V3\leqq V2\leqq V_{DD}$ for the column drivers are satisifed, where $V_{SSH}$, V4, V3, V2 and V1 are variables defining said predetermined waveform signals and $V_{DD}$ is a reference voltage.

19. A display according to claim 17 in which the output buffer means are arranged to provide a gain and output level within a predetermined dynamic range sufficient to enable the column driver circuit means to actuate the display elements for switching between said two states.

20. A display according to claim 17 in which the output buffer means each have a low impedance output.

21. A display according to claim 17 in which the timing and switching means is operative to switch at least one of the waveform output signals among three and only three predetermined levels and through three and only three phases.

22. A display according to claim 17 in which the matrix display panel is a ferroelectric liquid crystal display and the waveform generator means includes switching means for switching among three and only three predetermined levels and through three and only three phases to generate a waveform output signal defining said time variant signal.

23. A display according to claim 22 in which the controller means includes timing means for generatng a timing signal output to the driver circuit means for controlling the logical selection of the display states of the display elements and the waveform generator means includes phase timing means responsive to the timing signal output for synchronizing the waveform output signal to a predetermined phase with the logical selection of the display elements.

24. A display according to claim 22 in which the controller means includes timing means for generating a timing signal output to the driver circuit means for controlling the logical selection of the display states of the display elements and the waveform generator means includes phase timing means responsive to the timing signal output for varying the waveform output signal among three and only three levels and through three and only three phases in a predetermined sequence for each occurrence of the logical selection of the display state of the display elements.

25. A display according to claim 22 in which the controller means includes timing means for generating a timing signal output to the driver circuit means for controlling the logical selection of the display states of the display elements and the waveform generator means includes phase timing means responsive to the timing signal output for varying the waveform output signal through three and only three phases and among three and only three levels in a predetermined sequence in synchrony with each occurrence of the logical selection of the display state of the display elements.

26. A display according to claim 25 wherein said phase timing means includes means for generating phases of equal duration in the waveform output signal.

* * * * *